US011642903B2

(12) United States Patent
Gotschewski et al.

(10) Patent No.: US 11,642,903 B2
(45) Date of Patent: May 9, 2023

(54) PRINTHEAD CARRIERS AND ADAPTERS

(71) Applicant: ZEBRA TECHNOLOGIES CORPORATION, Lincolnshire, IL (US)

(72) Inventors: Robert P. Gotschewski, Schaumburg, IL (US); Timothy T. Anderson, Antioch, IL (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 17/405,811

(22) Filed: Aug. 18, 2021

(65) Prior Publication Data

US 2021/0370696 A1 Dec. 2, 2021

Related U.S. Application Data

(60) Continuation of application No. 16/664,288, filed on Oct. 25, 2019, now Pat. No. 11,117,403, which is a continuation of application No. 15/945,150, filed on Apr. 4, 2018, now Pat. No. 10,486,448, which is a continuation of application No. 15/615,182, filed on Jun. 6, 2017, now Pat. No. 9,962,972, which is a division of application No. 15/017,135, filed on Feb. 5, 2016, now Pat. No. 9,744,784.

(51) Int. Cl.

| | |
|---|---|
| ***B41J 23/34*** | (2006.01) |
| ***B41J 25/34*** | (2006.01) |
| ***B41J 2/335*** | (2006.01) |
| ***B41J 2/325*** | (2006.01) |
| ***B41J 25/312*** | (2006.01) |
| ***B41J 2/32*** | (2006.01) |

(52) U.S. Cl.

CPC ..... *B41J 25/34* (2013.01); *B41J 2/32* (2013.01); *B41J 2/325* (2013.01); *B41J 2/335* (2013.01); *B41J 25/312* (2013.01); *B41J 2202/31* (2013.01)

(58) Field of Classification Search

CPC ..... B41J 25/34; B41J 25/312; B41J 2202/31; B41J 25/304; B41J 2/32; B41J 2/325; B41J 2/335

See application file for complete search history.

(56) References Cited

U.S. PATENT DOCUMENTS 11,117,403 B2 * 9/2021 Gotschewski ..... B41J 25/34

* cited by examiner

*Primary Examiner* — Kristal Feggins

(57) ABSTRACT

Printhead carriers and adapters are disclosed. An example disclosed print mechanism includes an adapter to simultaneously couple a printhead assembly to both a logic circuit of a media processing device and a power source of the media processing device; a printhead carrier coupled to the adapter; and wherein a first connection, between data input connector and the logic circuit, and a second connection, between the power input connector and the power source, are maintained when the printhead assembly is removed from the print mechanism.

11 Claims, 18 Drawing Sheets

PRINTHEAD CARRIERS AND ADAPTERS

RELATED APPLICATION

This application is a continuation of U.S. application Ser. No. 15/615,182, filed Jun. 6, 2017, now U.S. Pat. No. 9,962,972, which is a divisional of U.S. patent application Ser. No. 15/017,135, now U.S. Pat. No. 9,744,784, filed Feb. 5, 2016, which are hereby incorporated herein by reference in their entirety.

FIELD OF THE DISCLOSURE

This disclosure relates generally to media processing devices and, more particularly, to printhead carriers and adapters.

BACKGROUND

Some media processing devices include a print mechanism to generate human and/or machine-readable indicia on a surface of media. The print mechanism includes a printhead that generates the indicia based on received data by, for example, depositing ink on the surface(s), thermally transferring ink to the surface(s), applying energy to particular sections of the surface(s), and/or via any other suitable printing technique.

DETAILED DESCRIPTION

Figure 1:
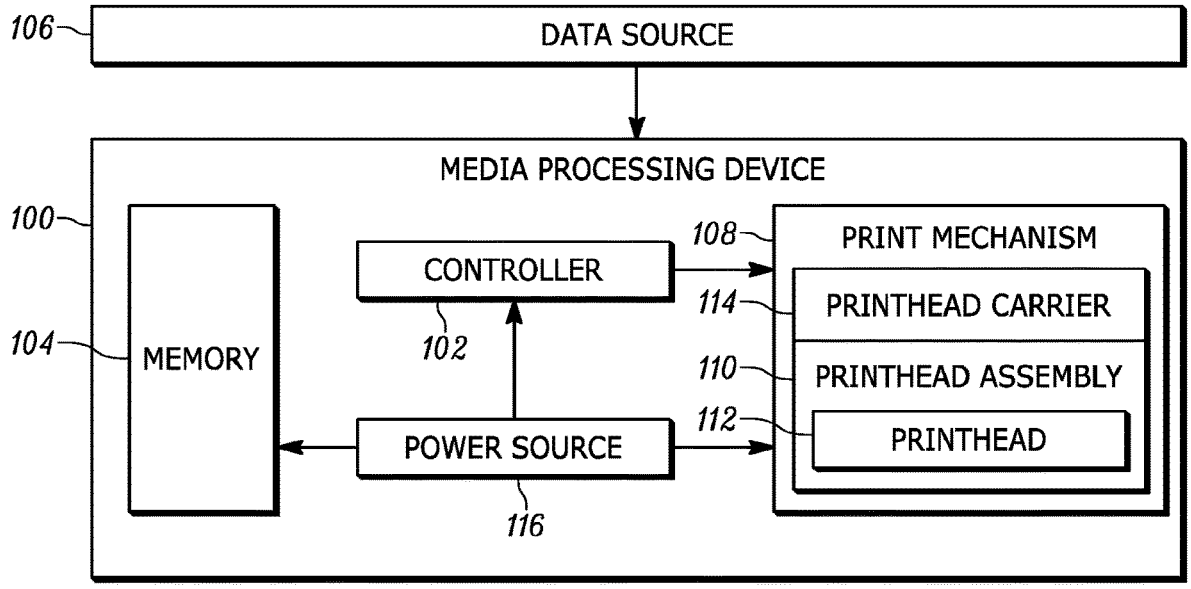
FIG. 1 is a block diagram representative of an example media processing device that may employ teachings of this disclosure.

Certain components of media processing devices are involved in precise operations. For example, performance of a print mechanism is dependent on the components thereof being properly aligned, oriented, biased, and/or otherwise configured. Although media processing devices are typically configured properly initially (e.g., when the devices are shipped and/or delivered), a need may arise to remove, reinstall, or replace one or more components. In such instances, proper removal and installation are important operations for maintaining proper configuration and, thus, desirable performance of the media processing device. Put another way, improper removal and/or installation of certain components may adversely affect performance of the media processing device.

A printhead is an example component for which proper removal and installation are important. For example, a thermal printhead is oriented and maintained in close proximity to print media during printing so that the printhead may apply energy to, for example, a thermal transfer ribbon or direct thermal media. If not returned to the proper position (e.g., with respect to alignment, distance, and/or orientation relative to a platen roller), the printhead may not transfer an expected amount of energy to an expected location on the thermal transfer ribbon or the direct thermal media. Moreover, in some instances, a proper amount of force applied to the printhead in a direction toward the platen roller is crucial. For example, without the proper amount of force or pressure applied to the printhead, a conveyance system including the platen roller may not properly feed media across the printhead. In some examples, without the proper amount of force or pressure applied to the printhead, a flow of heat generated by the printhead may have unintended or unexpected characteristics. Additional or alternative issues may result for different types of printheads being improperly removed and/or installed.

Example printhead carriers disclosed herein, which are sometimes referred to herein as "carriers," facilitate proper access operations (e.g., removal, installation, maintenance and/or cleaning) associated with a printhead assembly to be carried by the carrier. In particular, example carriers disclosed herein provide straightforward and convenient access to the printhead assembly and, thus, a printhead of the printhead assembly. As described in detail below, example carriers disclosed herein include first and second pivot mechanisms that enable a plurality of configurations of the carriers. For example, carriers disclosed herein are placed in a closed configuration, an open configuration, or an access configuration. When in the closed configuration, example carriers disclosed herein position the printhead in proximity with a media feed path and retain the printhead in the proper position relative to, for example, a platen roller over which media is fed. When in the open configuration, example carriers disclosed herein position the printhead at a distance further away from the media feed path relative to the closed configuration. The open configuration enables, for example, cleaning of the printhead. Example carriers disclosed herein transition from the closed configuration to the open configuration via the first pivot mechanism. In particular, example carriers disclosed herein pivot about a first axis defined by the first pivot mechanism, thereby moving the printhead away from the platen roller along a first arc. In the example open configuration disclosed herein, the printhead assembly remains secured to the carrier.

When in the access configuration with the printhead assembly installed, example carriers disclosed herein present the printhead assembly in a position at which the printhead assembly is removable from the carrier. In particular, the second pivot mechanism of example carriers disclosed herein pivots the printhead assembly away from the carrier about a second axis different than the first axis, thereby moving the printhead away from the carrier along a second arc different than the first arc. Put another way, the second pivot mechanism of example carriers disclosed herein enables the printhead assembly, when installed, to drop a certain distance away from the carrier, thereby providing clearance for access to the installed printhead assembly at an accessible angle.

When in the access configuration without the printhead assembly installed, example carriers disclosed herein enable the printhead assembly to be installed with clearance via an accessible angle. In particular, the second pivot mechanism of example carriers disclosed herein pivots to present a connector to receive the printhead assembly with ample clearance and at an accessible angle. Notably, example carrier assemblies provide these and other advantages while maintaining a compact size footprint for the media processing device.

As described in detail below, the printhead assembly is removably mated with an example adapter disclosed herein. In known media processing devices, the coupling and decoupling of the printhead involves connecting and disconnecting multiple connectors that are typically terminating ends of cables or wires. For example, when installing the printhead in such known media processing devices, the person is required to find the power cable, bring the power cable connector within reach of the printhead, align the power cable connector with the counterpart power connector on the printhead, properly mate the two power connectors, find one or more data cables, bring the one or more data cables within reach of the printhead, align the one or more data cable connectors with the counterpart data connector(s) on the printhead, and properly mate the data cables connectors.

Example adapters disclosed herein improve the processes of coupling and decoupling a printhead assembly to and from a media processing device. As described in detail below, example adapters disclosed herein provide a consolidated interface assembly that enables the printhead assembly to be coupled to and decoupled from the media processing device via a single action (e.g., a single insertion or a single disconnection) rather than having to couple or decouple both a power cable and one or more data cables. Example adapters disclosed herein include multiple input connectors (e.g., a power input connector and one or more data input connectors) that are coupled to appropriate sources (e.g., power cables, data cable(s), and/or connectors of a board), of the media processing device. Example adapters disclosed herein include a connector having alignment features (e.g., arms) that guide multiple outputs (e.g., ports) configured to engage counterpart inputs (e.g., pins or plugs) of a printhead assembly. As such, the printhead assembly is coupled to the media processing device via a single mating of the printhead assembly with the connector of example adapters disclosed herein. Further, the printhead assembly is decoupled from the media processing device via a single detachment of the printhead assembly from the connector of example adapters disclosed herein. Notably, the coupling of the printhead assembly to the media processing device enabled by example adapters disclosed herein does not include user interaction with any cables. Further, the decoupling of the printhead assembly from the media processing device enabled by example adapters disclosed herein does not sever the connection of cables to counterpart connectors.

In some examples, adapters disclosed herein are used in conjunction with example carriers disclosed herein. In some examples, the media processing device employs carriers disclosed herein without an adapter disclosed herein. In some examples, the media processing device employs adapters disclosed in connection with additional or alternative types of carriers and/or printhead assemblies than those disclosed herein.

FIG. 1 is a block diagram representative of an example media processing device 100 in which teachings of this disclosure may be implemented. The example media processing device 100 of FIG. 1 is a stand-alone unit. In some examples, the media processing device 100 is integrated into an apparatus such as, for example, an automatic teller machine (ATM), a kiosk, or a point-of-sale device. The example media processing device 100 of FIG. 1 employs one or more print technologies (e.g., direct thermal printing and/or thermal transfer printing) to generate indicia on media.

The example media processing device 100 of FIG. 1 includes a controller 102 configured to control certain components of the media processing device 100. In the illustrated example of FIG. 1, the controller 102 is a logic circuit configured to perform print functions. The example controller 102 of FIG. 1 is implemented by any suitable logic circuit such as, for example, one or more processors, microprocessor(s), coprocessor(s) and/or integrated circuit(s) (e.g., an ASIC (application specific integrated circuit), an FPGA (field programmable gate array), etc.). In some examples, the controller 102 is configured to execute instructions stored in memory 104 of the media processing device 100. The example memory 104 of FIG. 1 is implemented by, for example, volatile and/or non-volatile memory that may be either fixed or removable. The example memory 104 of FIG. 1 is configured to store information, data, applications, instructions and/or the like for enabling the controller 102 to carry out print functions.

The example controller 102 of FIG. 1 receives data representative of printing tasks (e.g., print jobs) from the memory 104 and/or an external data source 106. Examples of external data sources include a host device, a host system, a network device, and a removable storage device. In the illustrated example of FIG. 1, the controller 102 processes the received data such that the data is usable to print indicia on media. For example, the controller 102 of FIG. 1 utilizes a print engine to generate print data lines (e.g. directly or based on a bit map image) based on the received data.

In the example of FIG. 1, the controller 102 transmits the print data lines (or any other type of data usable to print indicia on media) to a print mechanism 108 of the media processing device 100. The example print mechanism 108 of FIG. 1 is configured to receive a printhead assembly 110 that includes a printhead 112. As described in detail below, the printhead assembly 110 is removably coupled to the print mechanism 108 via a printhead carrier 114. The example printhead 112 is configured to generate indicia on the media in accordance with the data received at the print mechanism 108. The example printhead 112 of FIG. 1 includes a driver implemented by a logic circuit configured to receive the data representative of the indicia to be printed. Additionally, the driver of the printhead 112 is configured to control one or more operations or functions of the printhead 112 based on the received data. For example, when the printhead 112 of FIG. 1 is implemented by a thermal printhead, the driver selectively energizes (e.g., heats) elements (e.g., printhead dots) of the printhead 112 according to the received data (e.g., print lines), thereby generating the corresponding indicia on media being fed through the media processing device 100 in proximity to the printhead 112. When the media processing device 100 is configured for direct thermal printing, direct thermal media is fed across the printhead 112 and the elements of the printhead 112 apply energy directly to the media, which changes color (e.g., from white to black or color) in response to the energy. When the media processing device 100 is configured for thermal transfer printing, ink ribbon and blank media are fed across the printhead 112 and the elements of the printhead 112 apply energy to the ink ribbon, which transfers ink to the blank media disposed against the ribbon in response to the energy.

When the media processing device 100 is configured to utilize direct thermal printing or thermal transfer printing, proper positioning of the printhead 112 relative to, for example, a platen roller is important. In particular, the platen roller and other components of a conveyance system (e.g., rollers) are configured to convey media and/or ink ribbon through a nip formed between the printhead 112 and the platen roller. Without a proper amount of pressure or force applied in association with contact between the printhead 112 and the platen roller, the media and/or the ink ribbon may not be properly conveyed through the nip. For example, if too much pressure or force is applied to the platen roller by the printhead 112, the ink ribbon may wrinkle. Alternatively, if not enough pressure or force is applied to the platen roller by the printhead 112, the media may not be fed through the nip at the proper rate (or at all). Moreover, the proper amount of pressure between the printhead 112 and the platen roller enables the proper heat flow from the heating elements of the printhead 112.

The example printhead carrier 114, which is sometimes referred to herein as the carrier 114, is configured to position the printhead assembly 110 (and, thus, the printhead 112) in a proper configuration for printing. The example print mechanism 108 of FIG. 1 employs a carrier constructed in accordance with teachings of this disclosure (e.g., the example carrier 400 of FIG. 4 described in detail below) to provide convenient access to the printhead 112, properly position and maintain the printhead 112 for printing, and facilitate effective installation, cleaning and/or removal of the printhead 112 from the print mechanism 108.

In the illustrated example of FIG. 1, the controller 102 and a power source 116 are placed in and out of electrical communication with the printhead 112 in response to the printhead assembly 110 being installed and removed from the carrier 114. The example print mechanism 108 of FIG. 1 may employ an example adapter constructed in accordance with teachings of this disclosure (e.g., the example adapter 906 of FIG. 9A described in detail below) to provide single-action installation and single-action removal of the printhead assembly 110 to and from the media processing device 100.

In some examples, the example print mechanism 108 of FIG. 1 utilizes an example carrier disclosed herein (e.g., the example carrier 400 of FIG. 4 described in detail below) in conjunction with an example adapter disclosed herein (e.g., the example adapter 906 of FIG. 9A described in detail below). Alternatively, the example print mechanism 108 of FIG. 1 utilizes an example carrier disclosed herein, and does not utilize an example adapter disclosed herein. Alternatively, the example print mechanism 108 of FIG. 1 utilizes an example adapter disclosed herein, and does not utilize an example carrier disclosed herein.

Figure 2:
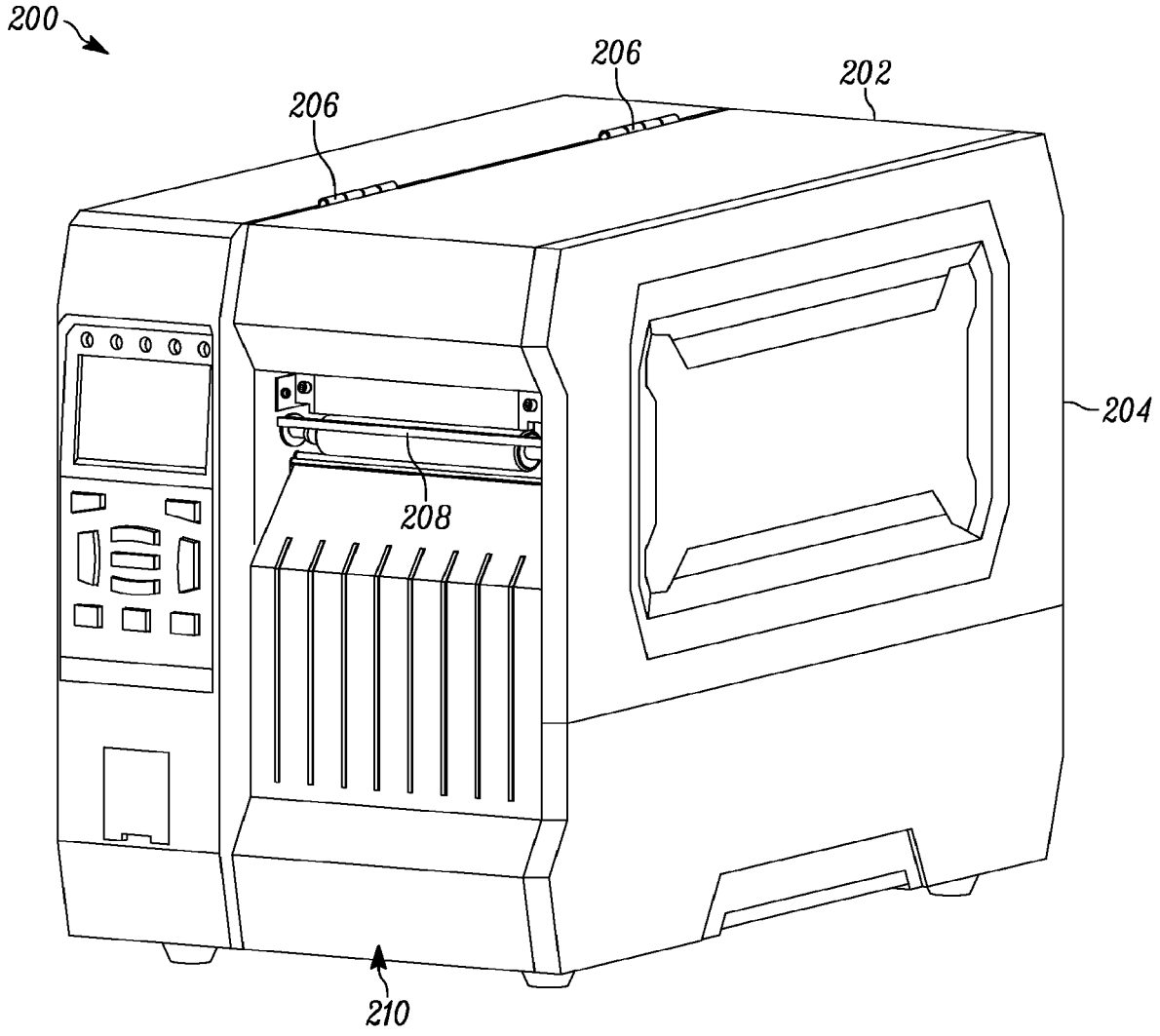
FIG. 2 depicts an example media processing device constructed in accordance with teachings of this disclosure.

FIG. 2 depicts an example implementation of the media processing device 100 of FIG. 1 constructed in accordance with teachings of this disclosure. The example media processing device 200 of FIG. 2 includes a housing 202 having a door 204. As depicted in FIG. 2, the door 204 is in a closed, operational position in which access to internal components is precluded. In addition to keeping dirt, dust, and foreign objects from entering an internal cavity of the media processing device 200 and potentially contaminating consumables or electronics, the door 204 may also reduce noise and prevent inadvertent touching of sensitive components. The example door 204 of FIG. 2 is hingedly attached to a frame of the media processing device 200 via hinges 206 such that the door 204 can be opened to provide access to the internal components of the media processing device 200. As described below in connection with FIG. 3, the frame includes a chassis to which some components of the media processing device 200 are mounted. For example, as described below, a print mechanism mounted to the chassis generates indicia on media fed to the print mechanism by components mounted to the chassis. The print mechanism outputs the media at an exit 208 located along a front face 210 of the housing 202.

Figure 3:
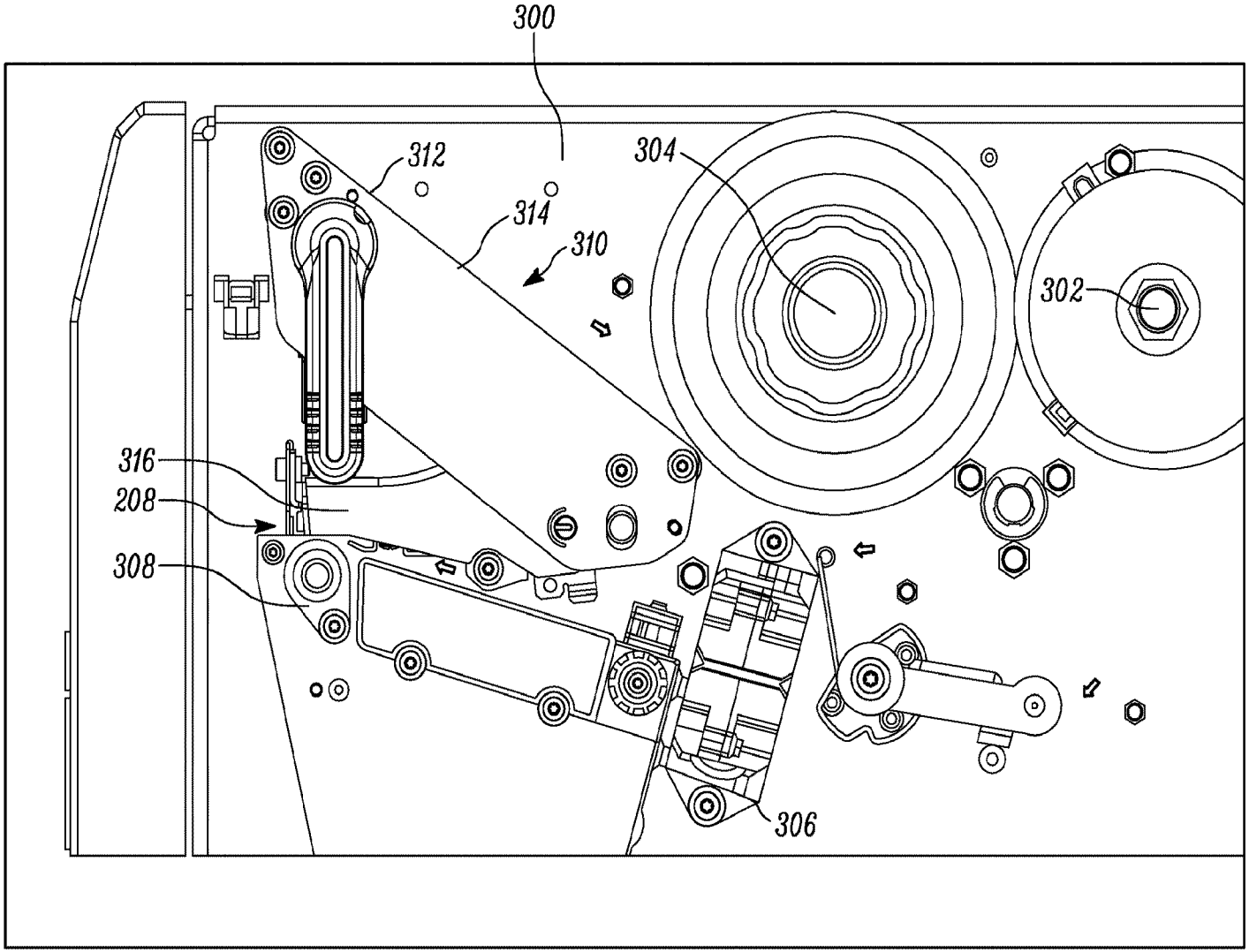
FIG. 3 is a side view of internal components of the example media processing device of FIG. 2.

FIG. 3 depicts a side view of a portion of the example media processing device 200 of FIG. 2 with the door 204 removed. A similar view of the internal cavity is available when the door 204 is opened. As shown in FIG. 3, a chassis 300 supports internal components of the media processing device 200 including a media spindle (not shown), a plurality of guide components (e.g., rollers that guide media and/or ribbon), a ribbon supply spindle 302, a ribbon take-up spindle 304, a transmissive sensor 306, a platen assembly 308, and a print mechanism 310. The media spindle (not shown) is configured to hold a spool of media that is fed to the print mechanism 310 and out the exit 208 (FIG. 2). The ribbon supply spindle 302 is configured to hold a spool of unused ribbon. The ribbon is fed from the ribbon supply spindle 302 to the print mechanism 310, which uses the ribbon to generate indicia on the media that is concurrently fed to the print mechanism 310. The ribbon take-up spindle 304 is configured to hold a spool of used ribbon (e.g., ribbon that has been fed through the print mechanism 310).

The example print mechanism 310 of FIG. 3 generates indicia on the media at a nip formed by a roller of the platen assembly 308 and a printhead. In the illustrated example of FIG. 3, the print mechanism 310 selectively applies heat to the ribbon in accordance with, for example, received print line data, thereby transferring indicia (e.g., ink) to the media adjacent to the ribbon in the nip. Alternatively, when direct thermal media is fed to the print mechanism 310 (e.g., when the media processing device 200 is in a direct thermal configuration), the ribbon is not fed to the print mechanism 310 and heat is selectively applied directly to the direct thermal media fed across the printhead, thereby causing a change in appearance of the media at selective locations.

The example print mechanism 310 includes a support structure 312 and removable covers 314 and 316 that shield the print mechanism 310.

Figure 4:
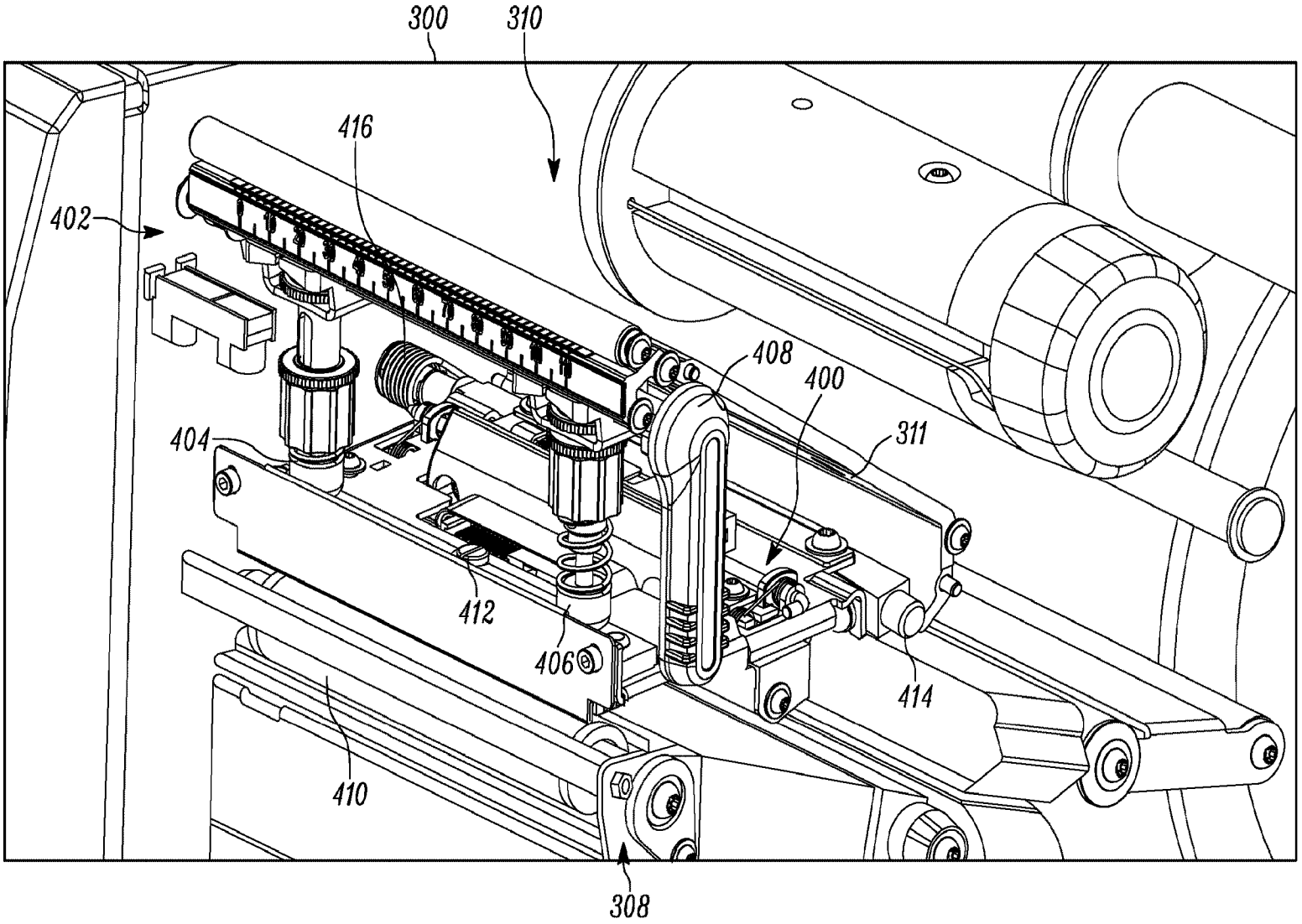
FIG. 4 is a perspective view of internal components of the example media processing device of FIG. 2 with a printhead carrier in a closed configuration.
Figure 8:
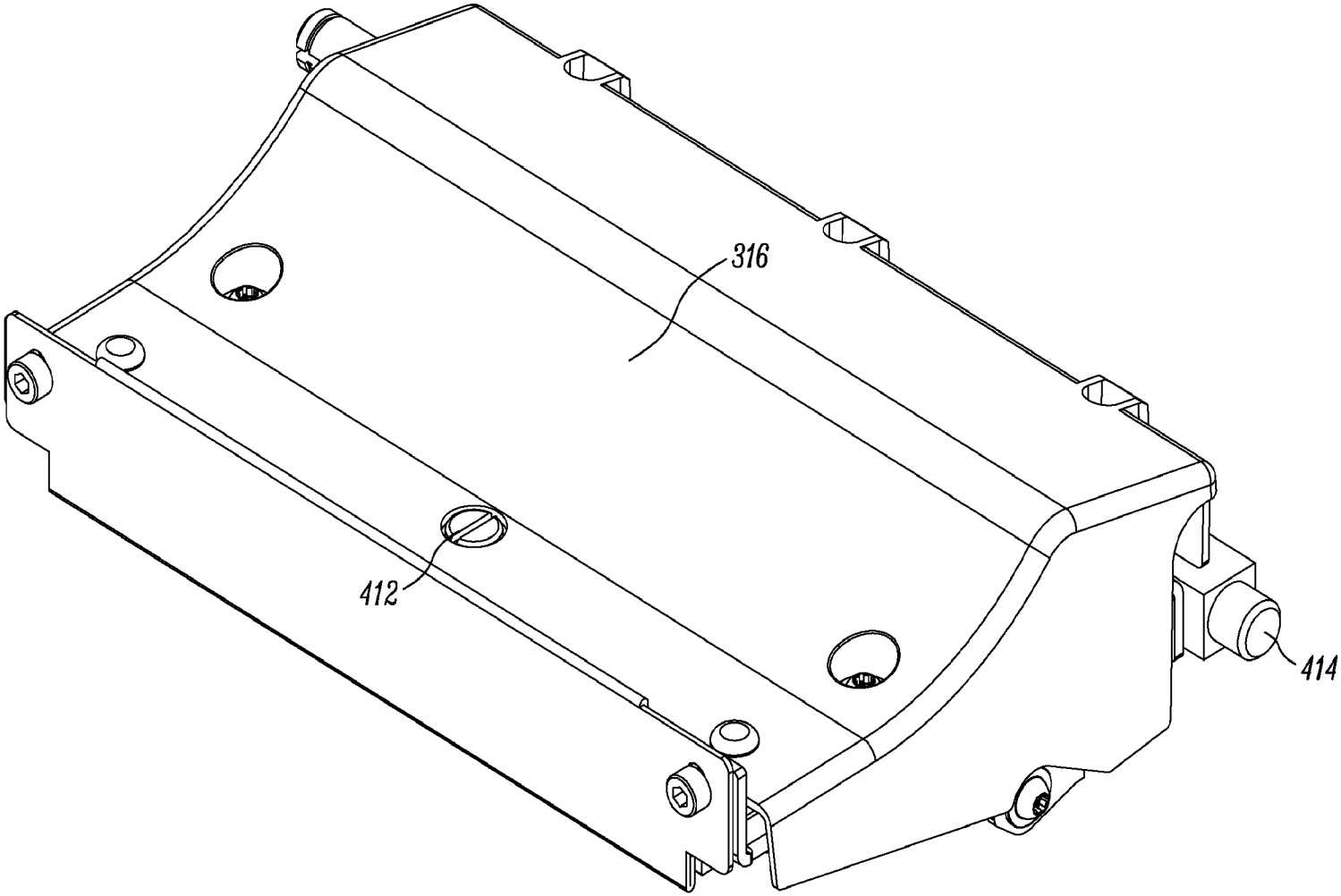
FIG. 8 is a perspective view of the example printhead carrier of FIG. 4 including a cover.

FIG. 4 is a perspective view of the print mechanism 310 with the covers 314 and 316 of FIG. 3 removed. FIG. 8 depicts the removable cover 316 as installed, which is described in detail below in connection with FIG. 8. The example print mechanism 310 of FIG. 4 includes a printhead carrier 400 (or simply "carrier 400") constructed in accordance with teachings of this disclosure. As depicted in FIG. 4, the example carrier 400 is in a closed configuration from which printing operations are performed. However, as described below, the example carrier 400 is alternatively placed in an open configuration (FIG. 6) or an access configuration (FIGS. 9A and 9B) for different types of operations (e.g., printhead removal, printhead cleaning and/or printhead installation).

Figure 6:
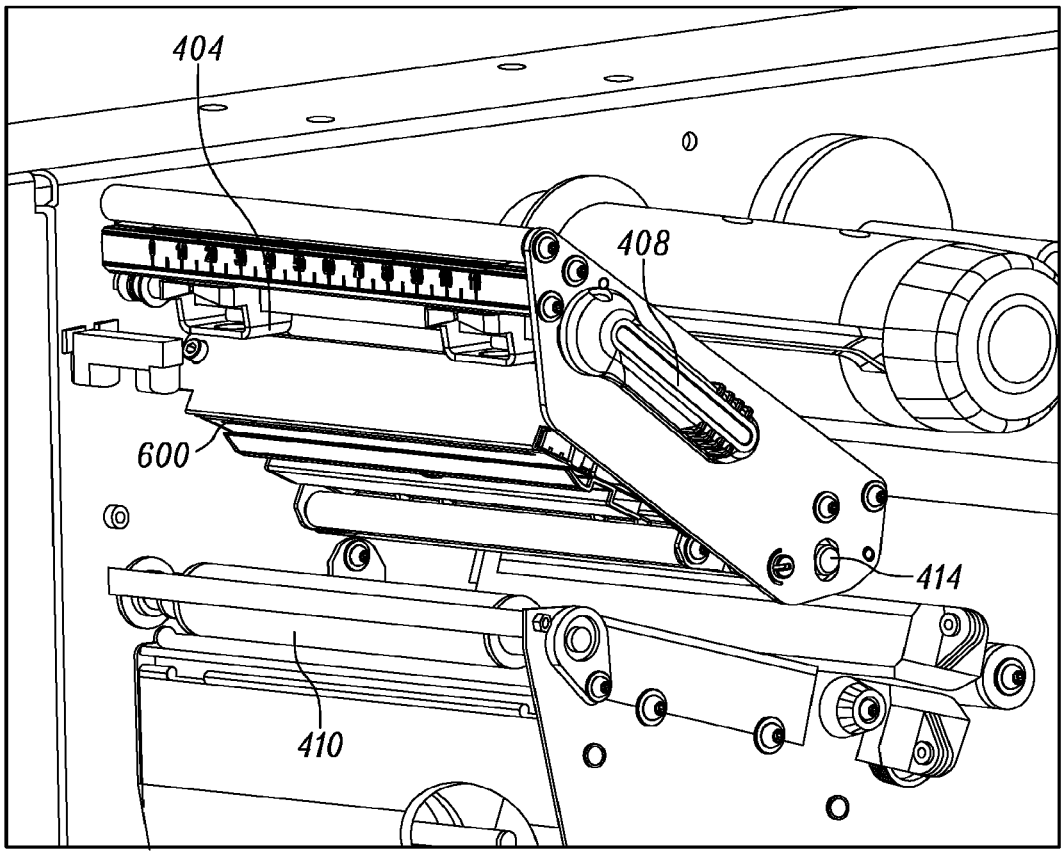
FIG. 6 is a perspective view of internal components of the example media processing device of FIG. 2 with the printhead carrier in an open configuration.

The example print mechanism 310 of FIG. 4 includes a toggle assembly 402 to retain the carrier 400 in the closed configuration and to allow the carrier 400 to transition to the open configuration or to the access configuration. The example toggle assembly 402 is hingedly mounted to the chassis 300 and is movable between an engaged position (FIG. 4) and a disengaged position (FIG. 6). The example toggle assembly 402 of FIG. 4 includes driving elements 404 and 406 and a handle 408. A manual rotation of the handle 408 moves the toggle assembly 402 between the engaged position (FIG. 4) and the disengaged position (FIG. 6).

With the toggle assembly 402 in the engaged position, the driving elements 404 and 406 apply an adjustable amount of force to the carrier 400. Although not shown in FIG. 4, the removable cover 316 is engaged by the example driving element 404 and 406 and the corresponding force is applied to the carrier 400 through the removable cover 316. In the illustrated example of FIG. 4, the driving elements 404 and 406 include barrels that are rotated (e.g., to predefined positions marked with indicators) to adjust an amount of force applied to the carrier 400. In some examples, the driving elements 404 and 406 include a curved profile configured to slidably engage a surface (e.g., of the removable cover 316) as the toggle assembly 402 is rotated. The curved profile of the driving elements 404 and 406 provides a cam-type functionality which moves along the corresponding surface as the toggle assembly 402 is rotated from the disengaged position to the engaged position. As such, the driving elements 404 and 406 drive the carrier 400 into position for printing. In some examples, contact areas between the driving elements 404 and 406 and the corresponding surface are configured to allow a sliding motion as the toggle assembly 402 is rotated.

In some examples, detents of the toggle assembly 402 are configured to retain the toggle assembly 402 in either the engaged position or the disengaged position. When the toggle assembly 402 is in the engaged position, the driving elements 404 and 406 hold the carrier 400 in position for printing. For example, the driving elements 404 and 406 hold the carrier 400 in a position such that a printhead 600 (FIG. 6) carried by the carrier 400 is properly aligned and oriented with a roller 410 of the platen assembly 308. Moreover, the example driving elements 404 and 406 ensure that a proper amount of pressure is applied to the printhead 600 in a direction toward the platen roller 410.

In response to the toggle assembly 402 being moved (e.g., via the handle 408) from the engaged position of to the disengaged position, the driving elements 404 and 406 are disengaged and, thus, do not apply the force to the carrier 400. When the toggle assembly 402 is in the disengaged position, the example carrier 400 is free to move from the closed configuration to the open configuration (FIG. 6) or to the access configuration (FIGS. 9A and 9B). Whether the carrier 400 transitions to the open configuration or the access configuration in response the toggle assembly 402 being disengaged is determined by whether or not the printhead 600 is secured against the carrier 400. In the illustrated example of FIG. 4, the printhead 600 is removably secured to the carrier 400 via a fastener (e.g., a bolt or a screw) 412. To transition the carrier 400 from the closed configuration (FIG. 4) to the open configuration (FIG. 6), the fastener 412 is left in place such that the printhead 600 remains secured to the carrier 400, and the toggle assembly 402 is moved to the disengaged position. As described below, the carrier 400 is biased to the open configuration and, in response to the disengagement of the toggle assembly 402, pivots away from the roller 410 in a first rotational direction to the open configuration. To transition the carrier 400 from the open configuration to the closed configuration, the toggle assembly 402 is moved from the disengaged position to the engaged position, thereby causing the driving elements 404 and 406 to apply pressure to the carrier 400 and place the printhead 600 in position for printing operations.

To transition the carrier 400 from the closed configuration (FIG. 4) to the access configuration (FIGS. 9A and 9B), the fastener 412 is loosened or removed such that the printhead 600 is unsecured from the carrier 400. With the printhead 600 unsecured from the carrier 400 and the toggle assembly 402 is moved to the disengaged position, the carrier 400 pivots away from the roller 410 in the first rotational direction and the printhead 600 pivots away from the carrier 400 in a second rotational direction opposite of the first rotational direction.

Figure 5:
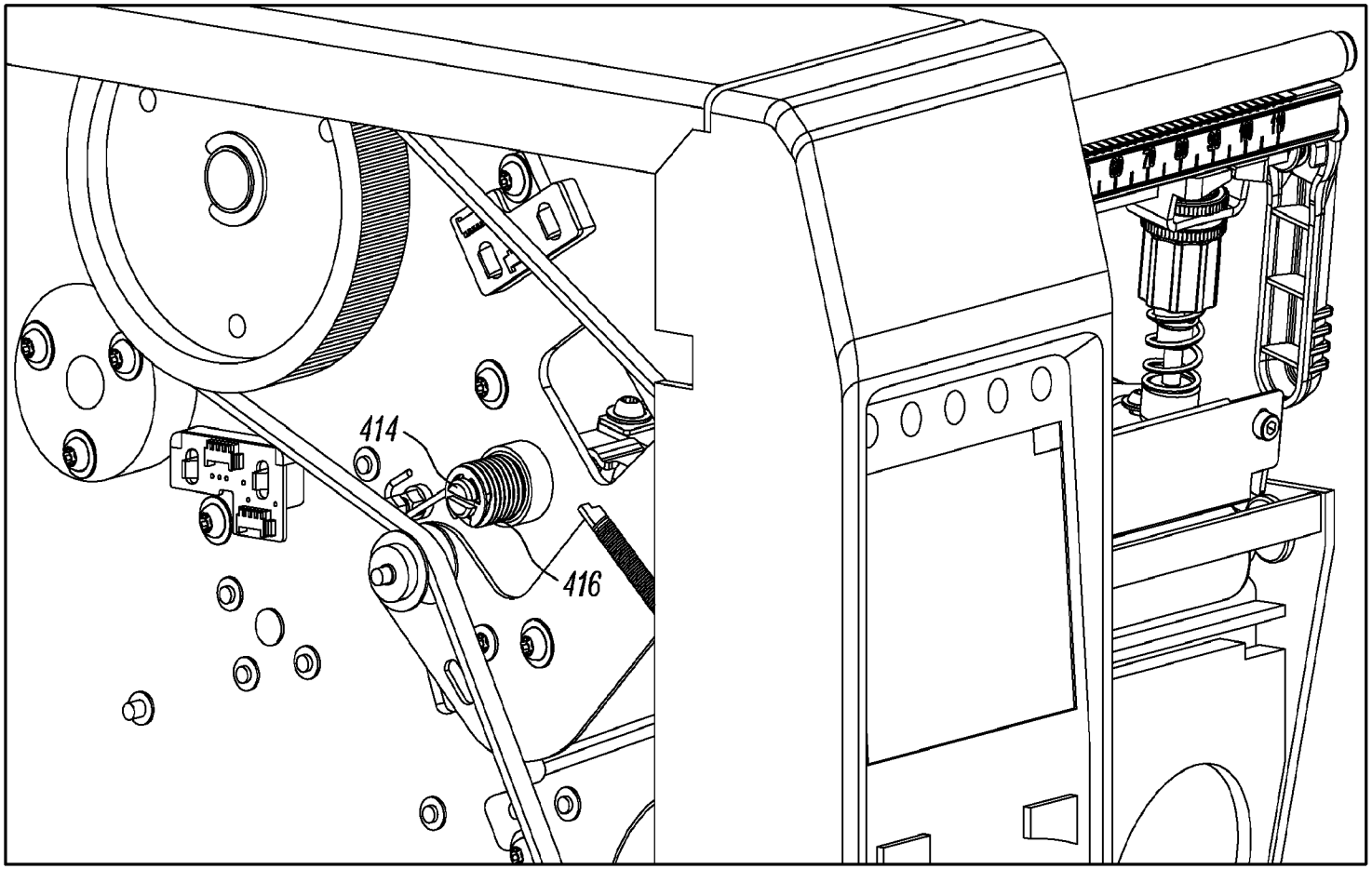
FIG. 5 is a perspective view of internal components of the example media processing device of FIG. 2.

To enable the pivoting of the carrier 400 toward and away from the roller 410, the example carrier 400 of FIG. 4 is hingedly mounted to the chassis 300 via a first pivot mechanism 414. FIG. 4 shows a first side of the chassis 300 and FIG. 5 shows a second, opposing side of the chassis 300. As shown in FIG. 5, an end of the first pivot mechanism 414 extends through the chassis 300. A biasing element (e.g., a spring) 416 is mounted to the end of the first pivot mechanism 414 that extends through the chassis 300 from the internal cavity covered by the door 204. As shown in FIGS. 4 and 5, a portion of the biasing element 416 is located on another side of the chassis opposing the internal cavity. In the illustrated example, the first pivot mechanism 414 is biased via the biasing element 416 to move the carrier 400 to the open configuration. Accordingly, when the carrier 400 is free to move (e.g., is not engaged by the driving elements 404 and 406), the example carrier 400 pivots about an axis defined by the first pivot mechanism 416 in the first rotational direction away from the platen roller 410. In the illustrated example, the biasing element 416 applies a range of motion (e.g., a number of degrees of rotation) to control the distance traveled by the carrier 400 away from the roller 410. That is, the example biasing element 416 is configured to position the carrier 400 at a desirable distance away from the roller 410 for the open configuration and the access configuration that enables the user to effectively interact with the carrier 400 and/or the printhead 600 being carried by the carrier 400. The separation between the carrier 400 and the platen roller 410 provided by the first pivot mechanism 414 enables, for example, cleaning of the printhead 600, installation or adjustment of the ribbon, installation or adjustment of the media, installation of the printhead 600, and/or removal of the printhead 600.

Figure 7:
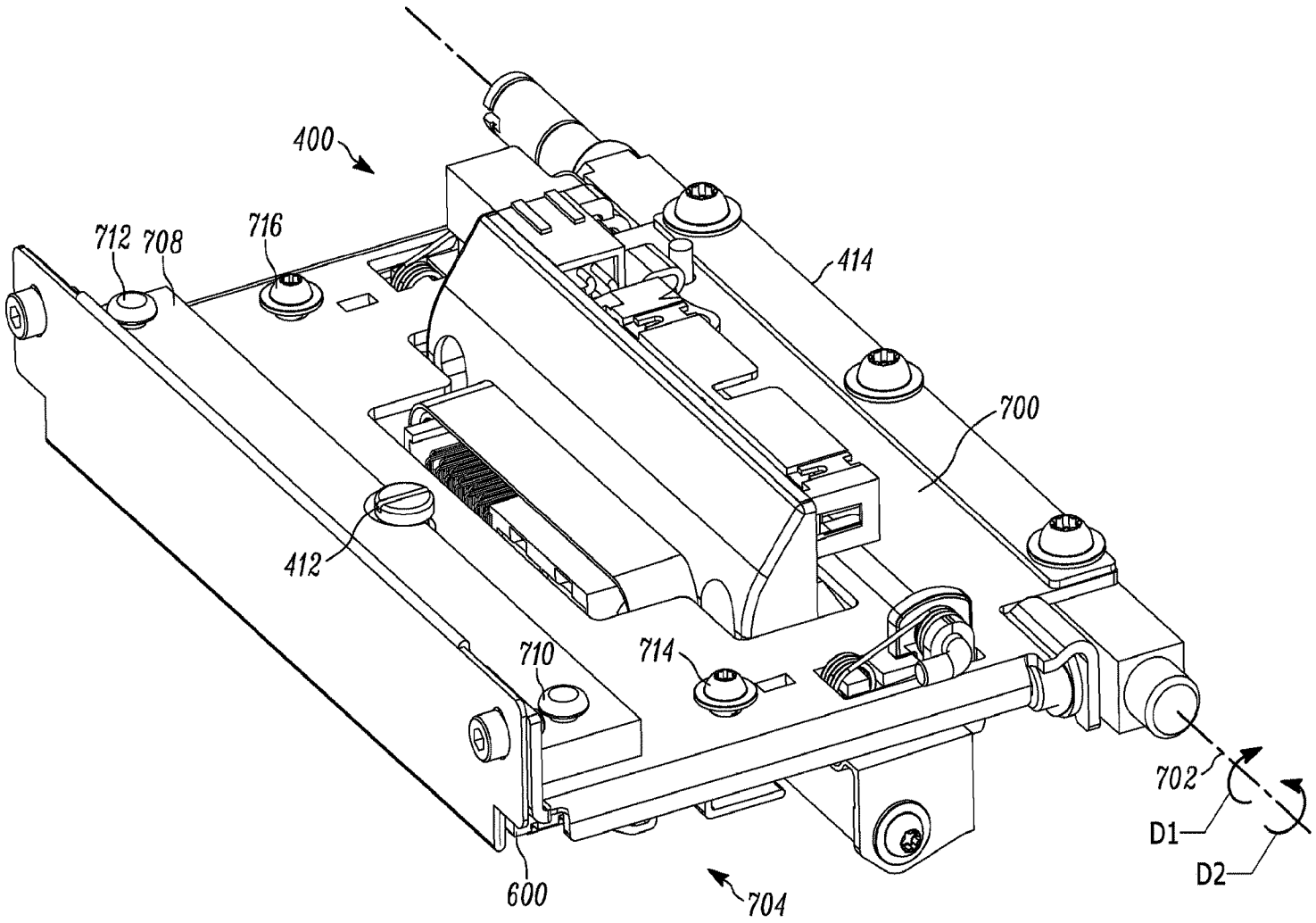
FIG. 7 is a perspective view of the example printhead carrier of FIG. 4 corresponding to the closed configuration of FIG. 4.

FIG. 7 is a perspective view of the example carrier 400 of FIG. 4 without the removable cover 316. FIG. 8 illustrates the removable cover 316 installed on the carrier 400 to protect components of the carrier 400. The example carrier 400 of FIG. 7 includes a base 700 fixedly attached (e.g., by bolts or screws) to the first pivot mechanism 414. As the first pivot mechanism 414 rotates in response to the toggle assembly 402 transitioning from the engaged position to the disengaged position, the attached base 700 pivots about a first axis 702 in the first rotational direction represented by a first arrow D1 in FIG. 7. Consequently, a printhead assembly 704 carried by the carrier 400 also pivots about the first axis 702 in the first rotational direction D1. The example printhead assembly 704 of FIG. 7 includes the printhead 600 shown in FIG. 6. The printhead 600 is positioned proximate the roller 410 in the closed configuration (FIG. 4) for printing operations. Accordingly, the printhead 600 pivots about the first axis 702 away from the roller 410 in the first rotational direction D1 when the carrier 400 moves or transitions from the closed configuration to the open configuration (FIG. 6) and when the carrier 400 moves or transitions from the closed configuration to the access configuration (FIGS. 9A and 9B). Additionally, the printhead 600 pivots about the first axis 702 toward the roller 410 in a second rotational direction D2 when the carrier 400 moves or transitions from the open configuration (FIG. 6) to the closed configuration (FIG. 4) and when the carrier 400 moves or transitions from the access configuration (FIGS. 9A and 9B) to the closed configuration. In particular, the printhead 600 travels in the first and second rotational directions along an arc defined by dimensions of the base 700 (e.g., a length extending from the first pivot mechanism 414 to an opposing end of the base 700) and the first pivot mechanism 414 when moving toward or away from the roller 410.

As described above, the printhead assembly 704 is secured to the carrier 400 via the fastener 412. In the illustrated example of FIG. 7, the fastener 412 extends through an aperture in the base 700 and is received (e.g., via a threaded hole) by the printhead assembly 704. In the illustrated example of FIG. 7, a force distribution bar 708 includes an arcuate cutout to accommodate the fastener 412. The example force distribution bar 708 of FIG. 7 is not directly attached to the base 700 to accommodate thermal expansion of, for example, the printhead 600 and/or the base 700. As shown in FIGS. 7 and 8, the example force distribution bar 708 is attached to the removable cover 316 via rivets 710 and 712 (or any other suitable type of fastener(s)). The example removable cover 316 is attached to the base 700 via screws 714 and 716 (or any other suitable fastener(s)). The example removable cover 316 is engaged by the driving elements 404 and 406 of the toggle assembly 402, thereby applying a force to the force distribution bar 708.

When secured to the base 700 via the fastener 412, the printhead assembly 704 is held against the base 700. Accordingly, when the driving elements 404 and 406 no longer apply a force to the force distribution bar 708 (through the thickness of the removable cover 316) and the fastener 412 is holding the printhead assembly 704 against the base 700, the example carrier 400 transitions via the first pivot mechanism 414 from the closed configuration to the open configuration shown in FIG. 6.

Alternatively, when the driving elements 404 and 406 no longer apply a force to the force distribution bar 708 and the fastener 412 is not holding the printhead assembly 704 against the base 700, the carrier 400 moves away from the roller 410 in the first rotational direction D1 via the first pivot mechanism 414 and the printhead assembly 704 moves away (e.g., drops) from the base 700 in the second rotational direction D2. This transition places the carrier 400 in the access configuration shown in FIGS. 9A and 9B. To enable the movement of the printhead assembly 704 away from the base 700 in the second rotational direction D2, the carrier 400 includes a second pivot mechanism 900 (FIG. 9A). The example second pivot mechanism 900 pivots about an axis 902 defined by a shaft 904. As the second pivot mechanism 900 pivots about the axis 902 away from the base 700, an adapter 906 mounted to the second pivot mechanism 900 pivots away from the base 700. In the illustrated example, the printhead assembly 704 is removably coupled to the carrier 400 via the adapter 906. Accordingly, when installed, the printhead assembly 704 pivots in conjunction with the second pivot mechanism 900. Moreover, when the printhead assembly 704 is not installed, the adapter 906 is presented for coupling with the printhead assembly 704 in the access configuration shown in FIGS. 9A-B. As such, the second pivot mechanism 900 enables convenient (e.g., with significant clearance and at an accessible angle) coupling and decoupling between the printhead assembly 704 and the carrier 400.

Figure 9A:
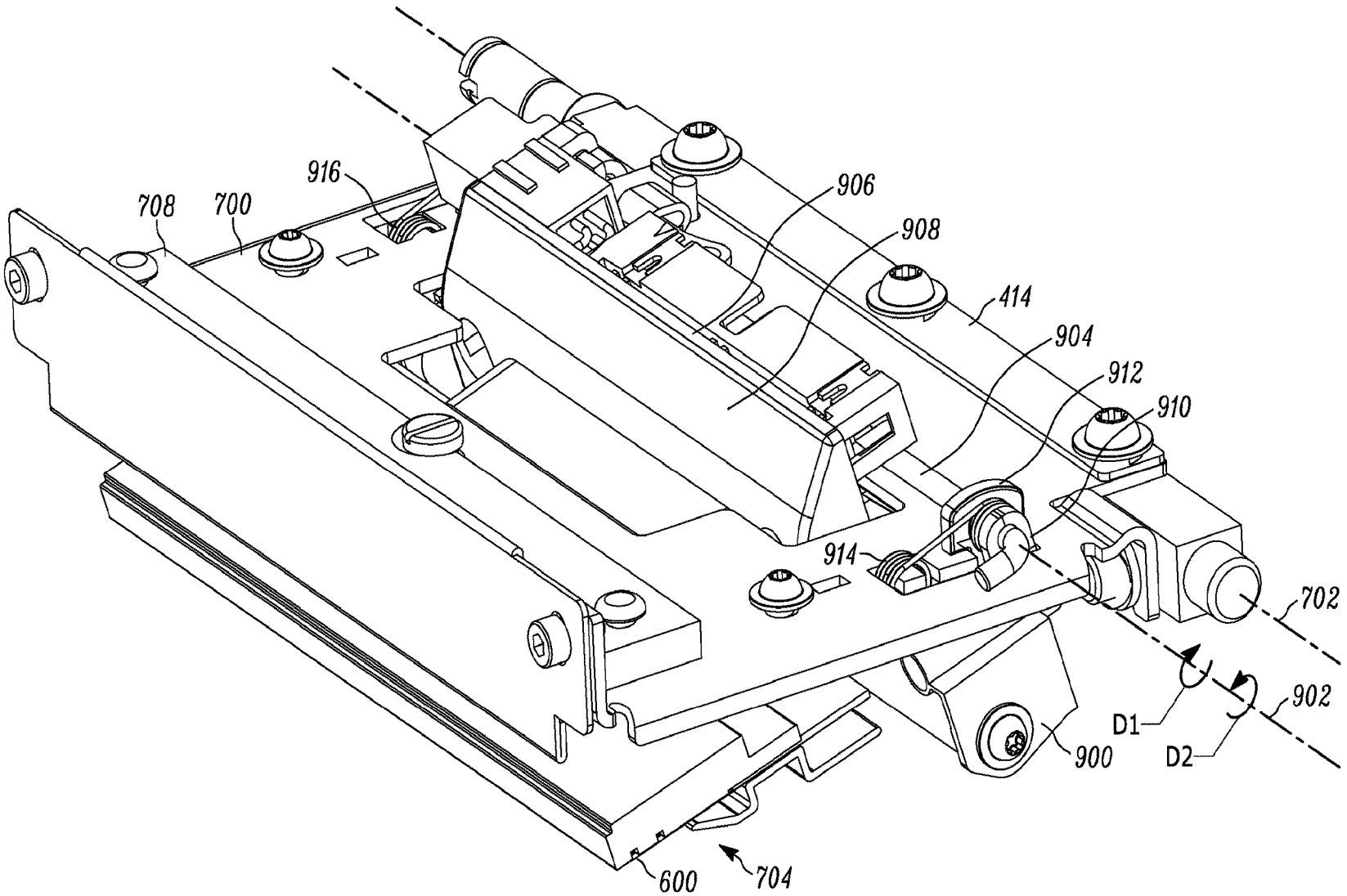
FIG. 9A is a perspective view of the example printhead carrier of FIG. 4 in an access configuration.
Figure 9B:
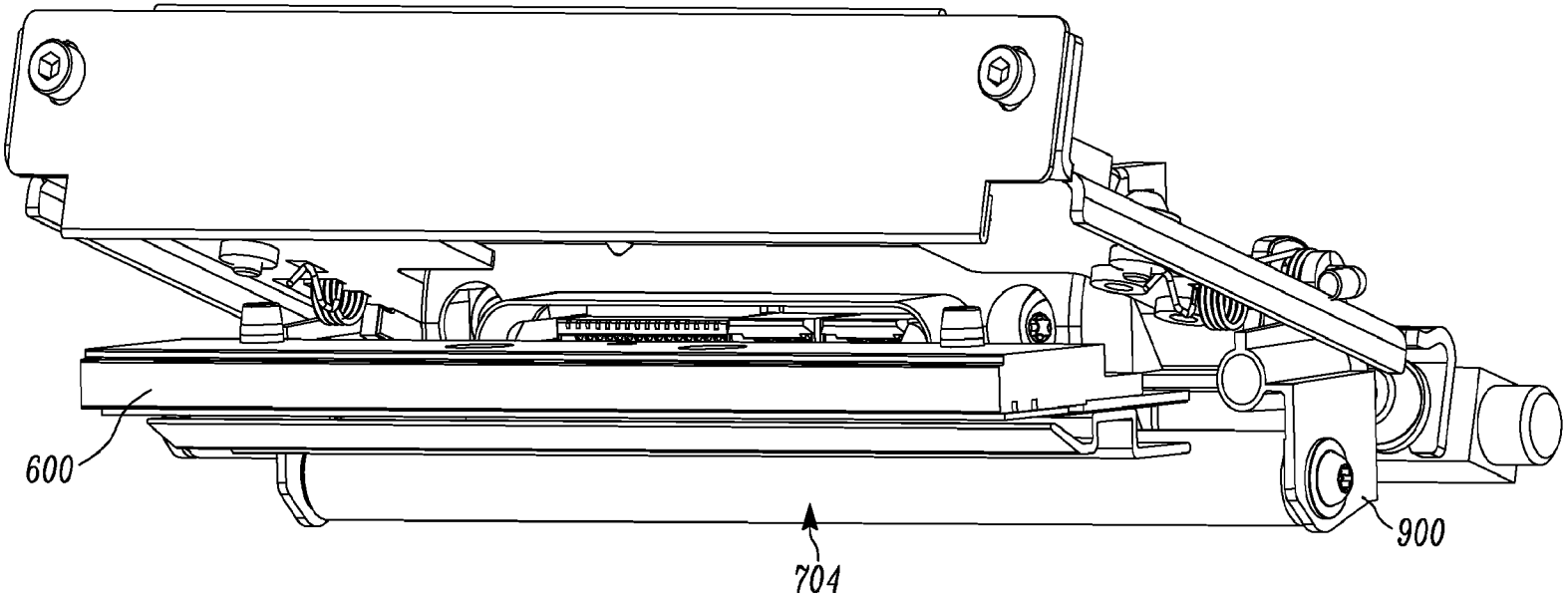
FIG. 9B is another perspective view of the example printhead carrier of FIG. 4 in the access configuration.
Figure 10:
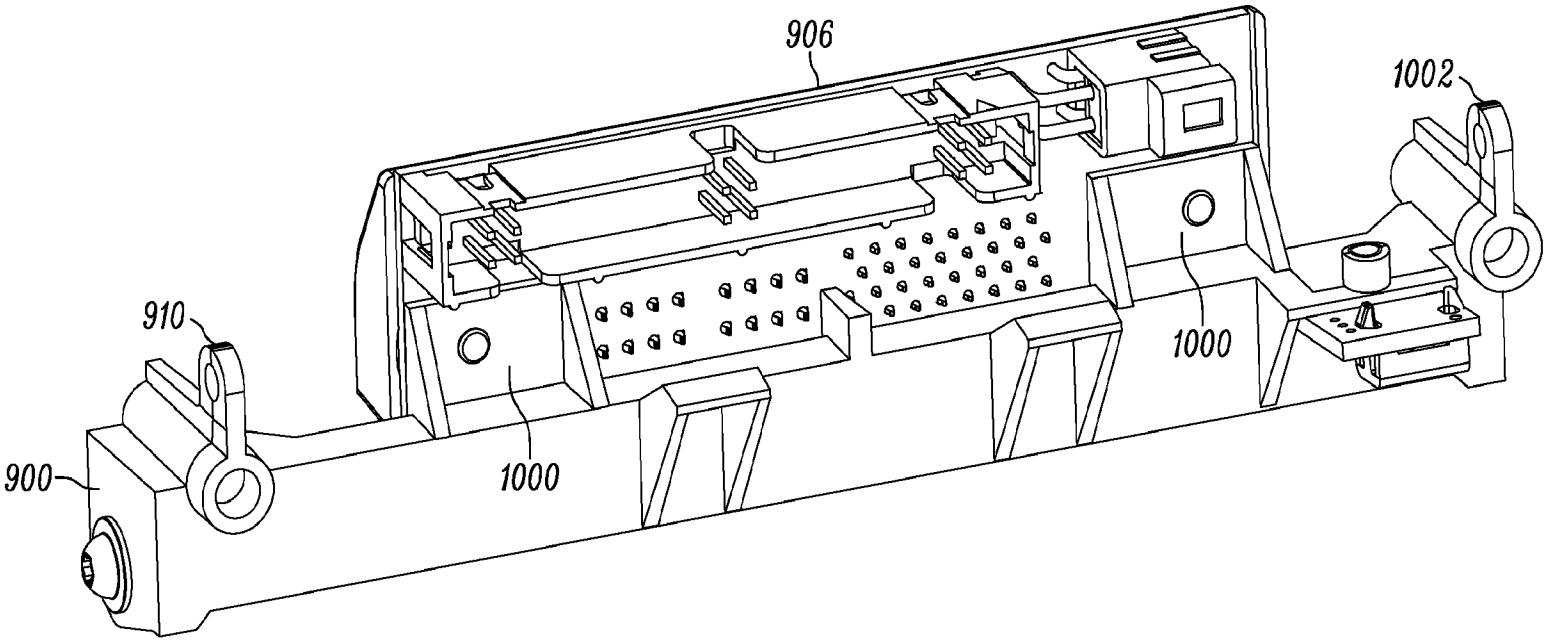
FIG. 10 is a rear perspective view of an example adapter constructed in accordance with teachings of this disclosure mounted to an example pivot mechanism.
Figure 11:
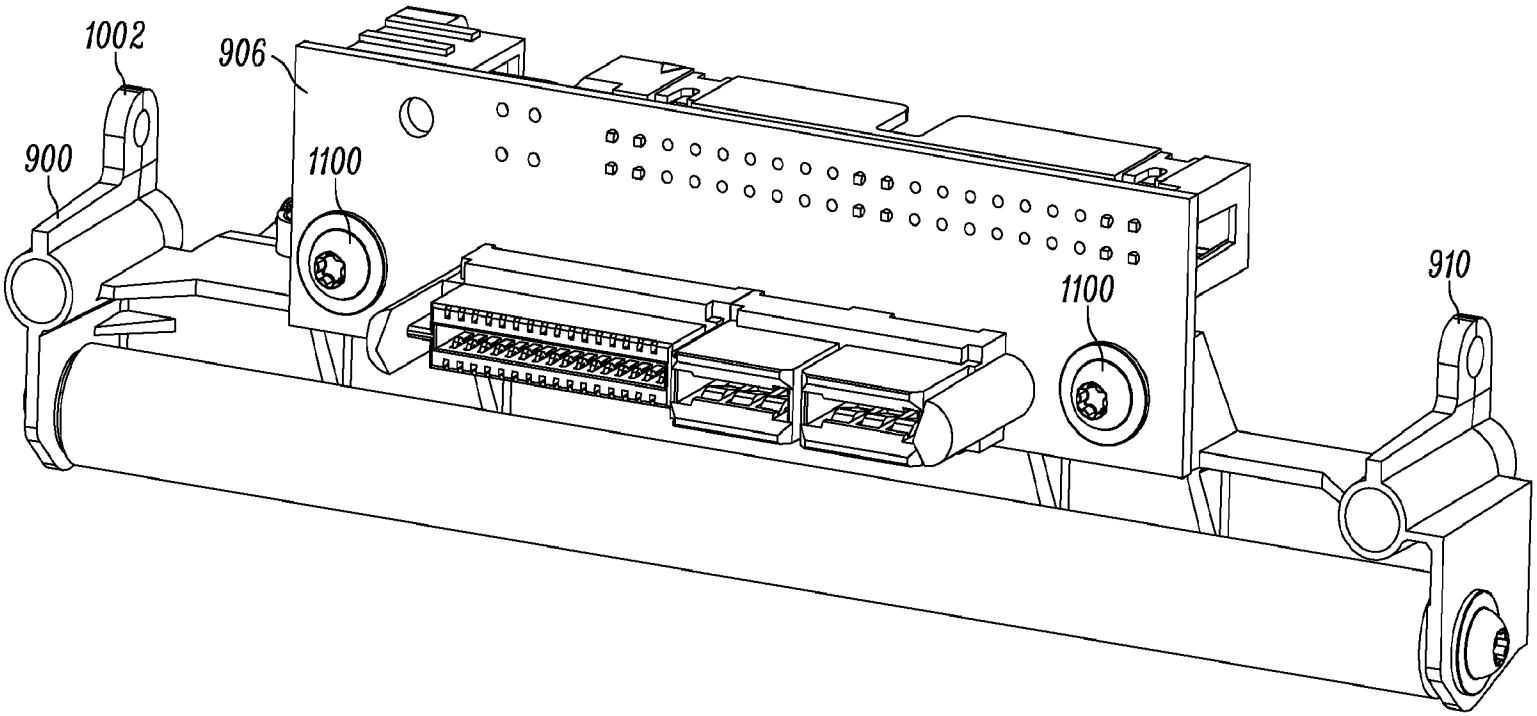
FIG. 11 is a front perspective view of the example adapter of FIG. 10 mounted to the example pivot mechanism.
Figure 12:
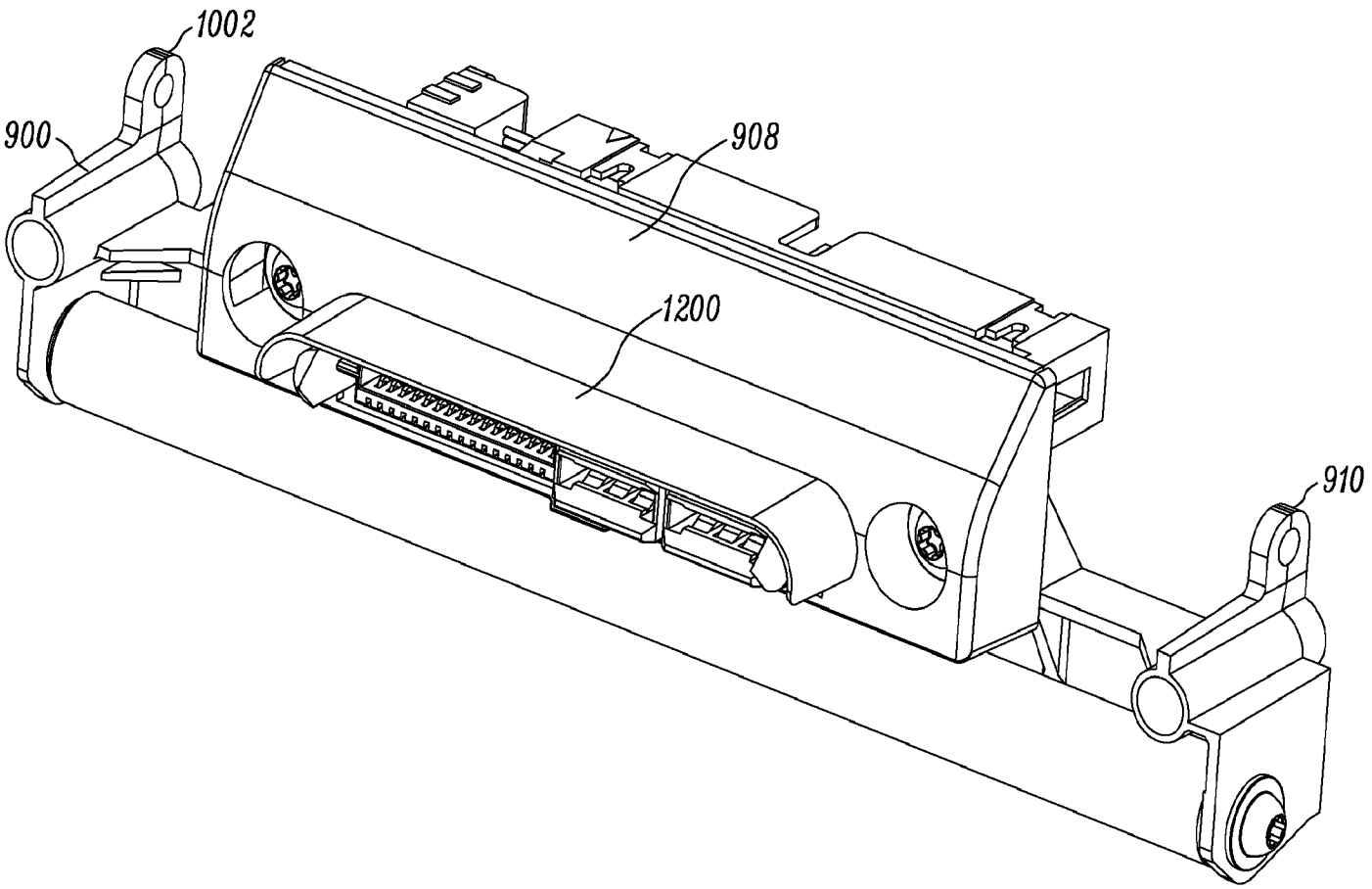
FIG. 12 is a front perspective view of the example adapter of FIG. 10 mounted to the example pivot mechanism.

In FIG. 9A a view of portions of the adapter 906 is precluded by a cover 908. However, FIGS. 10-12 illustrate the mounting of the adapter 906 to the second pivot mechanism 900. FIG. 10 is a rear perspective view of the example adapter 906 mounted to the example second pivot mechanism 900 of FIGS. 9A-B via mounting brackets 1000. As shown in FIG. 10, the example adapter 906 is fixedly coupled to the second pivot mechanism 900 such that the example adapter 906 rotates or pivots in conjunction with the second pivot mechanism 900.

FIG. 11 is a front perspective view of the example adapter 906 mounted to the example second pivot mechanism 900 of FIGS. 9A-B. The cover 908 is not shown in FIG. 9. As shown in FIG. 11, the example adapter 906 is coupled to the mounting brackets 1000 of the second pivot mechanism 900 by any suitable fasteners 1100 such as, for example, screws or bolts. The example adapter 906 of FIG. 11 includes apertures that are aligned with (e.g., positioned and spaced apart in accordance with) the mounting brackets 1000 of the second pivot mechanism 900.

FIG. 12 is the front perspective view of FIG. 11 with the cover 908 depicted. The example cover 908 is shaped to fit within a corresponding opening in the base 700 such that the cover 908 and the adapter 906 are able to pivot within the opening in the base 700. The example cover 908 includes apertures that enable access to the fasteners 1100 of FIG. 11. Additionally, the cover 908 includes an alignment feature 1200 that guides the coupling of the printhead assembly 704 with the adapter 906. The mating of the adapter 906 and the printhead assembly 704, as well as additional details of the example adapter 906 are described in detail below in connection with FIGS. 17 and 18.

Figure 13:
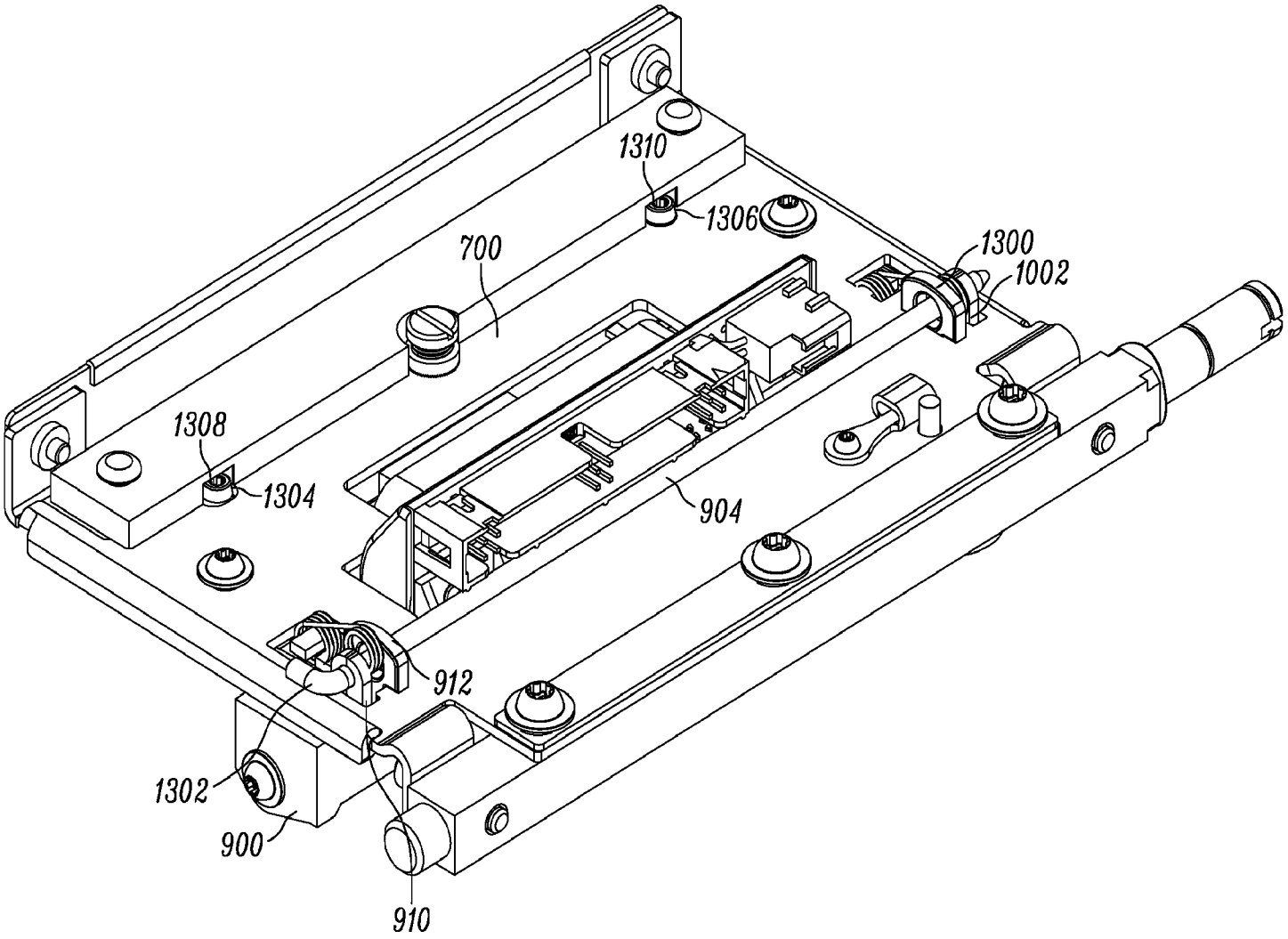
FIG. 13 is a rear perspective view of the example printhead carrier of FIG. 4.

Returning to FIGS. 9A-B, the adapter 906 pivots via the second pivot mechanism 900 along a second arc away from and toward the base 700 about the second axis 902 defined by the shaft 904. In the illustrated example, the second axis 902 is different than but parallel to the first axis 702 defined by the first pivot mechanism 414. The example second pivot mechanism 900 of FIG. 9A is coupled to the shaft 904 via first and second extension portions 910 and 1002 (FIG. 10) of the second pivot mechanism 900. Each of the extension portions 910 and 1002 includes an aperture to receive the shaft 904. The extension portions 910 and 1002 extend from the second pivot mechanism 900 through openings in the base 700. Additionally, the example carrier 400 includes first and second retainers 912 and 1300 (FIG. 13) that receive the shaft 904. In the illustrated example, the retainers 912 and 1300 are separate components from the second pivot mechanism 900. Each of the example retainers 912 and 1300 is shaped to fit within an opening in the base 700 at a particular position and to be maintained in that position. In the illustrated example, each of the retainers 912 and 1300 include one or more shoulders that engage a surface of the base 700 such that the retainers 912 and 1300 are maintained in position. The shaft 904 extends through apertures in the retainers 912 and 1300 and through the extension portions 910 and 1002 of the second pivot mechanism 900. As shown in the example of FIG. 13, the shaft 904 includes a bent end 1302 to restrict axial movement of the shaft 904 in a first direction. In the illustrated example, the removable cover 316 restricts axial movement of the shaft 904 in a second direction.

Figure 14:
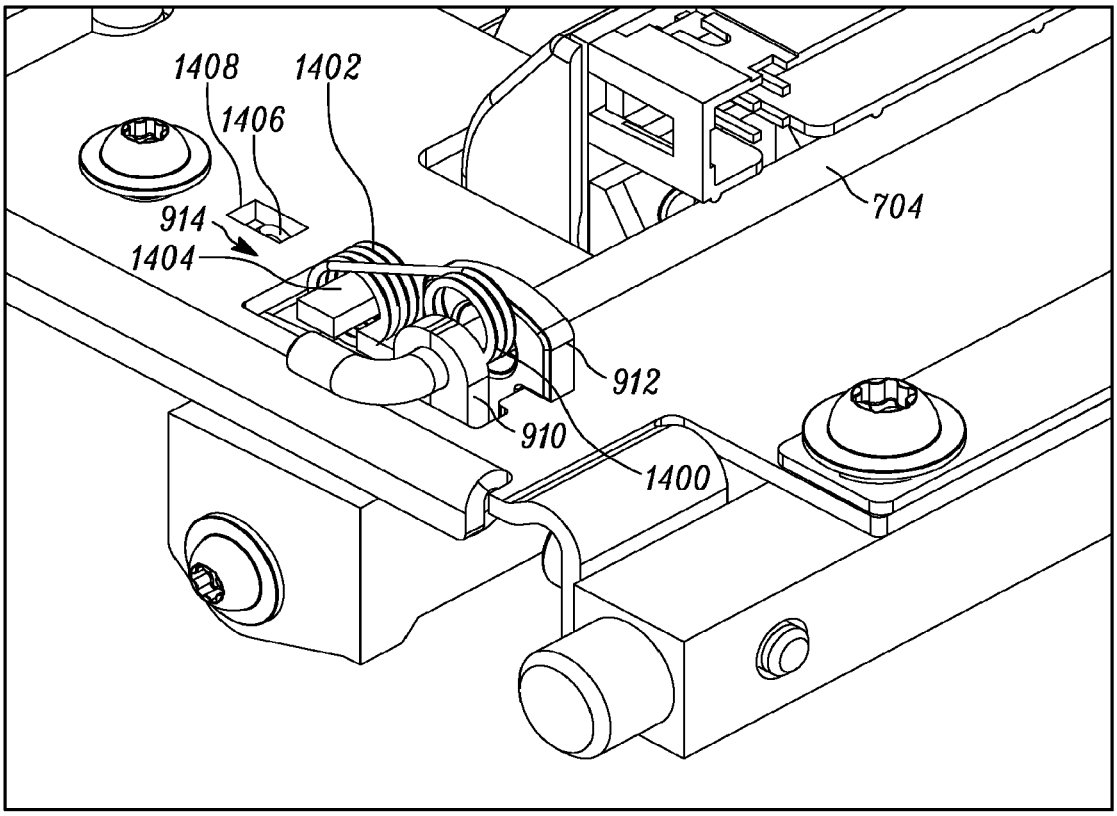
FIG. 14 is a perspective view of a portion of the example printhead carrier of FIG. 4 including an example biasing element.
Figure 15:
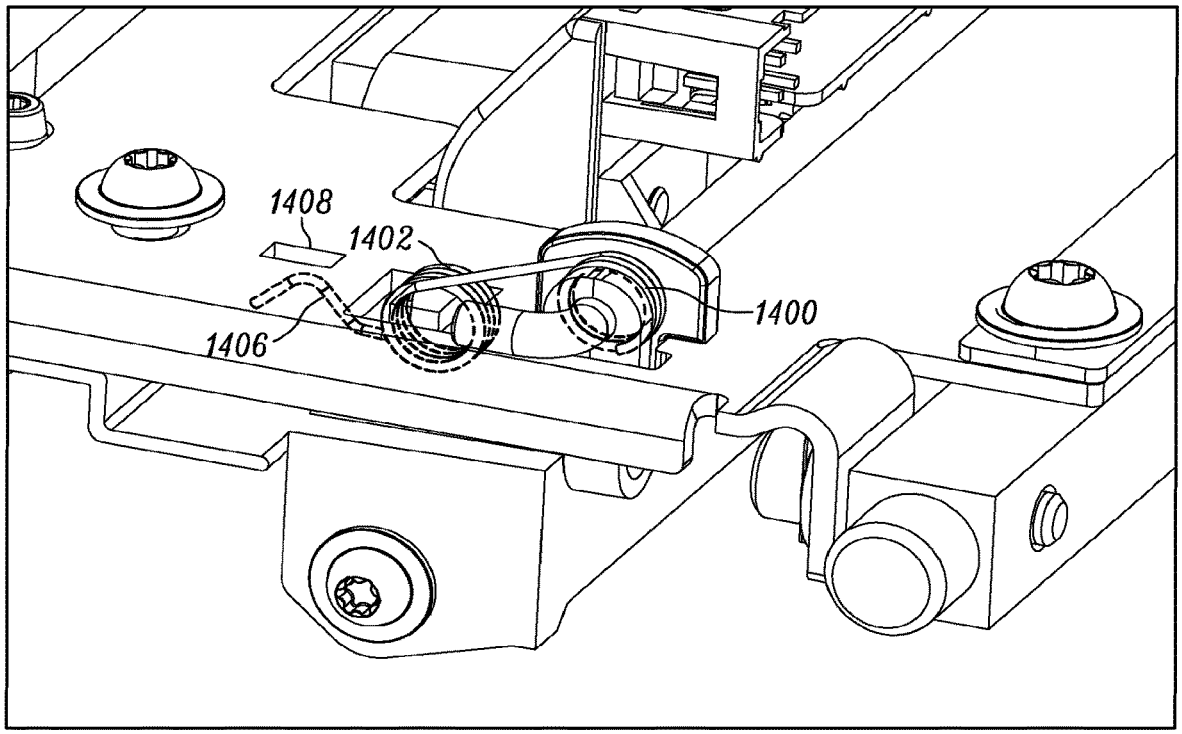
FIG. 15 is a rear perspective view of a portion of the example printhead carrier of FIG. 4 including the example biasing element of FIG. 14.
Figure 16:
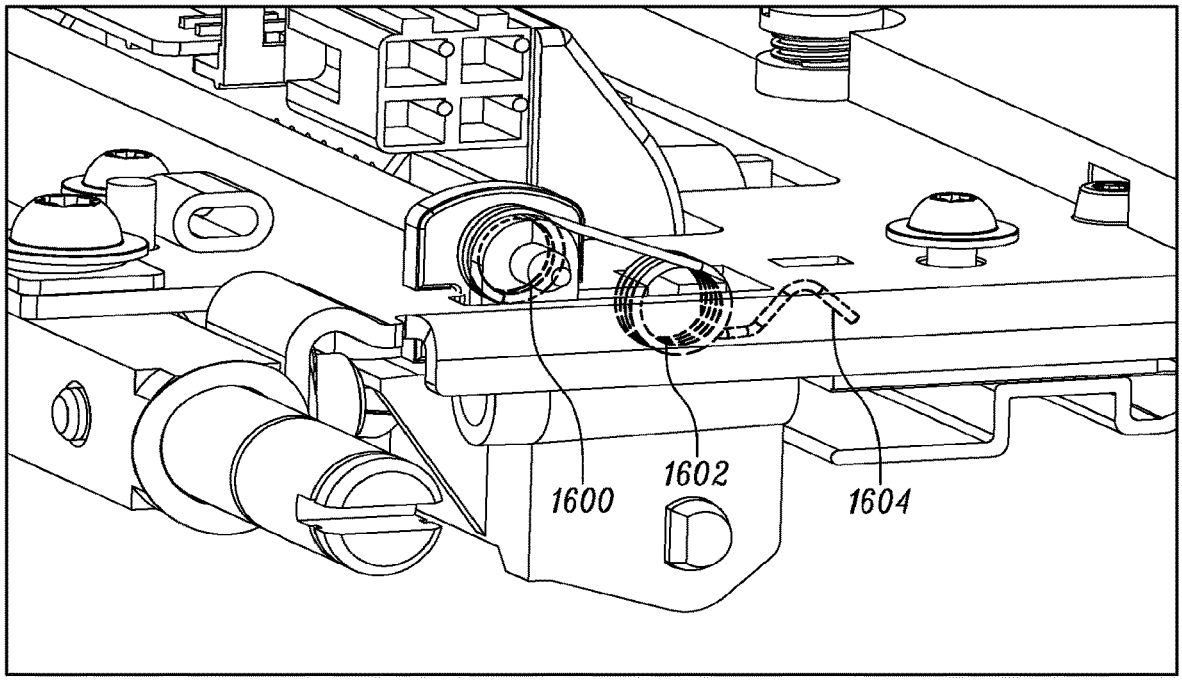
FIG. 16 is a rear perspective view of a portion of the example printhead carrier of FIG. 4 including an example biasing element.

Additionally, the example carrier 400 includes first and second biasing elements 914 and 916 that couple the shaft 904 to the base 700. In the illustrated example, the biasing elements 914 and 916 are each implemented by a torsion spring constructed with teachings of this disclosure. FIGS. 14-16 illustrate an example implementation of the biasing elements 914 and 916 of FIG. 9. As shown in the example of FIG. 14, the first biasing element 914 includes a first portion 1400 into which the shaft 904 is inserted. The example first portion 1400 of FIG. 14 has a diameter to enable the shaft 904 to pass through. When assembled with the carrier 400, the example first portion 1400 of the first biasing element 914 is located between the first extension portion 910 and the first retainer 912, which assists with locating the second pivot mechanism 900. The example first biasing element 914 of FIG. 14 includes a second portion 1402 into which a tab 1404 of the base 700 is inserted. The example second portion 1402 of the first biasing element 914 has parameters (e.g., number of coils, wire diameter, stress correction factor, etc.) that yield a desired amount of torque. The first and second portions 1400 and 1402 of the first biasing element 914 are connected. The example first biasing element 914 of FIG. 14 includes a third portion 1406 that extends from the second portion 1402. As shown in the example of FIG. 14, an arc of the example third portion 1406 of the biasing element 914 is positioned in an aperture 1408 in the base 700.

FIG. 15 illustrates a shape of the example first biasing element 914 of FIG. 14. As shown in FIG. 15, the third portion 1406 of the first biasing element 914 extends from the second portion 1402 to a side of the base 700 against which the printhead assembly 704 abuts (when installed), into the aperture 1408 in the base 700, and back to the side of the base 700 against which the printhead assembly 704 is mounted (when installed). For purposes of clarity and not limitation, the side of the base 700 against which the printhead assembly 704 is mounted (e.g., in the closed configuration and the open configuration) is referred to herein as a bottom side, while the opposing side of the base 700 is referred to herein as a top side.

FIG. 16 illustrates a shape of the example second biasing element 916 of FIG. 9A. The example second biasing element 916 of FIG. 16 has a similar shape as the example first biasing element 914 of FIG. 15. The example second biasing element 916 of FIG. 16 includes first, second, and third portions 1600, 1602, and 1604.

The example first and second biasing elements 914 and 916 ensure proper engagement of the printhead assembly 704 with the base 700 and, thus, alignment of the printhead 600. In particular, the first and second biasing elements 914 and 916 capture the shaft 904 in a manner that compensates for a downward bias exerted by the adapter 906 and component(s) coupled to the adapter 906 (e.g., a power cable and/or data cable(s)). For example, the biasing elements 914 and 916 provide a floating arrangement through which the shaft 904 (and, thus, the second pivot mechanism 900) is coupled to the base 700. While the printhead assembly 704 is fastened to the base 700 via the fastener 412 at an upstream end of the carrier 400, components located near a downstream end of the carrier bias the printhead assembly 704 downwards. However, the biasing elements 914 and 916 and the shaft 904 counteract this downwards bias by capturing the downstream end of the printhead assembly 704 against the base 700 with tolerances provided by the biasing elements 914 and 916 and the floating arrangement between the biasing elements 914 and 916 and the shaft 906. Put another way, the example biasing elements 914 and 916 and the shaft 904 maintain proper (e.g., flush or parallel) engagement of the printhead assembly 700 with the base 700 of the carrier 400.

Figure 17:
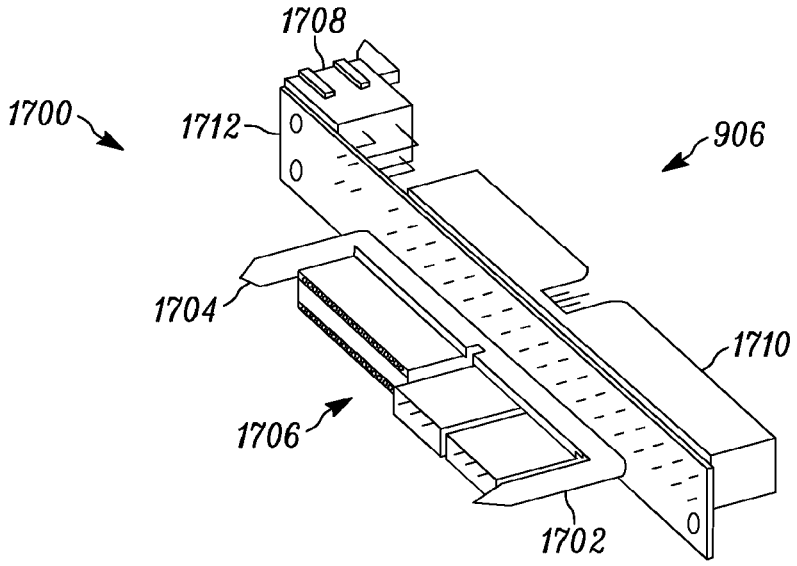
FIG. 17 is a perspective view of an example adapter constructed in accordance with teachings of this disclosure.

FIG. 17 illustrates an example implementation of the adapter 906 constructed in accordance with teachings of this disclosure. While the example adapter 906 of FIG. 17 is implemented in the example carrier 400 described above, the example adapter 906 of FIG. 17 can be implemented in alternative print mechanisms (e.g., without the example carrier 400 of FIG. 4). The example adapter 906 of FIG. 17 is configured to implement a removable coupling of the example printhead assembly 704 shown in FIG. 18. The example printhead assembly 704 of FIG. 18 corresponds to the printhead assembly 704 described above in connection with FIGS. 6 and 7. However, the example adapter 906 of FIG. 17 can be implemented to mate with alternative printhead assemblies.

Figure 18:
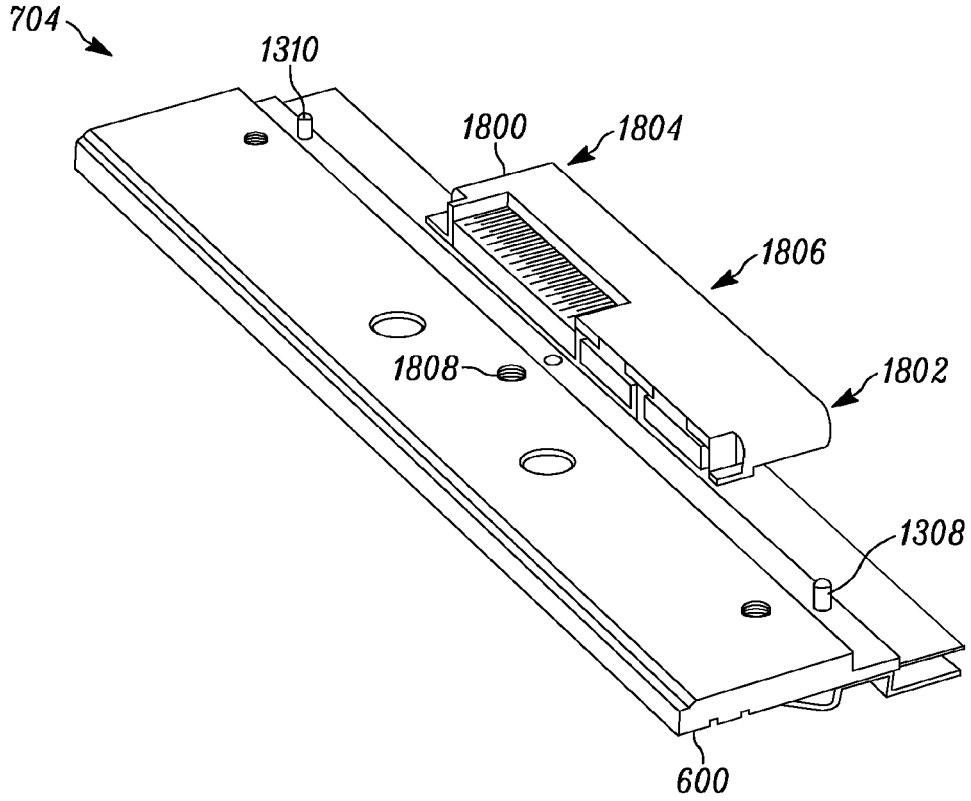
FIG. 18 is a perspective view of an example printhead assembly to matingly engage the example adapter of FIG. 17.

The example printhead assembly 704 of FIG. 18 is removably coupled to the example adapter 906 of FIG. 17 in a single action or movement by matingly engaging or disengaging a female connector 1700 of the adapter 906 and a counterpart male connector 1800 of the printhead assembly 704. The example female connector 1700 of the adapter 906 includes alignment arms 1702 and 1704 configured to be received at alignment receptacles 1802 and 1804 of the printhead assembly 704. The example female connector 1700 of the adapter 906 includes a plurality of ports 1706 arranged to matingly engage counterpart plugs 1806 of the example the male connector 1800 of the printhead assembly 704. Accordingly, a plurality of electrical connections are established simultaneously via the single engagement of the adapter 906 and the printhead assembly 704. Further, a plurality of electrical connections are severed simultaneously via the single disengagement of the adapter 906 and the printhead assembly 704.

The example adapter 906 FIG. 17 includes a power input connector 1708 and a data input connector 1710. In some examples, the example adapter 906 includes a different number of power input connectors and/or a different number of data input connectors. The example power input connector 1708 of FIG. 17 is coupled to (e.g., via one or more cables or directly to a board) a power source of, for example, the example media processing device 200 of FIG. 2. The example data input connector 1710 of FIG. 17 is coupled to (e.g., via one or more cables or directly to a board) a data source such as, for example, a logic circuit of the example media processing device 200 of FIG. 2 and/or an external data source.

In the illustrated example of FIG. 17, the power input connector 1708 and the data input connector 1710 are mounted to a board 1712. The ports 1706 of the female connector 1700 are in electrical communication with the power input connector 1708 and the data input connector 1710 via the board 1712. Accordingly, when engaged with the male connector 1800 of the printhead assembly 704, the example adapter 906 of FIG. 17 transmits power and data received from the respective sources of the media processing device 200 to the printhead assembly 704. As such, the printhead assembly 704 receives the power required to operate (e.g., selectively energize thermal elements of the printhead 600) and the data representative of the indicia to be generated on the media, as described above in connection with FIGS. 1-3.

Notably, the power connection and the data connection between the example adapter 906 of FIG. 17 and the corresponding sources (e.g., the power source of the media processing device 200 and the source of data) are maintained even when the printhead assembly 704 is removed from the media processing device 200. In some examples, the power connection and/or the data connection between the example adapter 906 of FIG. 17 and the corresponding sources are implemented by one or more cables that may be awkward to maneuver in the constrained space of the media processing device 200 (e.g., due to one or more loops formed in the cables due to a length of the respective cables) and/or may be improperly connected and/or disconnected. Accordingly, maintaining the power connection and the data connection between the media processing device 200, even with the printhead assembly 704 removed from the media processing device 200, as accomplished by the example adapter 906 of FIG. 17, improves the processes of removal and installation of the printhead assembly 704.

While the example connector 1700 of the adapter 906 is described above as female and the example connector 1800 of the printhead assembly 704 of FIG. 18 is described above as male, the connector 1700 of the adapter 906 may be configured as a male connector and the connector 1800 of the printhead assembly 704 may be configured as a female connector. That is, the electrical connections between the adapter 906 and the printhead assembly 704 are accomplished via any suitable relationship between the connectors. Moreover, the example adapter 906 can employ any suitable additional or alternatives type(s) of connector(s).

As described above, the example adapter 906 is mounted to the second pivot mechanism 900 and the printhead assembly 704 is captured against the base 700 of the carrier 400. Proper alignment of the printhead assembly 704 is important for successful printing operations. The example adapter 906 and the example carrier 400 establish and maintain the proper alignment using a plurality features. For example, the alignment arms 1702 and 1704 of the adapter 906 cooperate with the alignment receptacles 1802 and 1804 to establish and maintain alignment between the adapter 906 and the printhead assembly 704. Additionally, the alignment feature 1200 of the cover 908 guides the printhead assembly 704 into and out of engagement with the adapter 906. Additionally, the example carrier 400 includes apertures 1304 and 1306 (FIG. 13) configured to receive posts 1308 and 1310 (FIG. 13) that extend from the printhead assembly 704, thereby aligning the printhead assembly 704 with the carrier 400 and the platen roller 410 (e.g., by positioning an edge of the printhead 600 in parallel with a longitudinal axis of the platen roller 410). As shown in FIG. 13, the example force distribution bar 708 is shaped to accommodate the posts 1308 and 1310 that protrude through the apertures 1304 and 1306. Additionally, the fastener 412 is received by a threaded receptacle 1808 of the printhead assembly 704 to position the printhead 600 in a desired location against the base 700 of the carrier 400.

Although certain example apparatus, methods, and articles of manufacture have been disclosed herein, the scope of coverage of this patent is not limited thereto. On the contrary, this patent covers all apparatus, methods, and articles of manufacture fairly falling within the scope of the claims of this patent.

What is claimed is:

1. A print mechanism, comprising:

an adapter configured to simultaneously couple a printhead assembly to both a logic circuit of a media processing device and a power source of the media processing device, the adapter including a data input connector and a power input connector; and a printhead carrier coupled to the adapter wherein a first connection between the data input connector and the logic circuit and a second connection between the power input connector and a power source are maintained when the printhead assembly is removed from the print mechanism;

wherein the printhead carrier comprises a base to carry the printhead assembly, a first pivot mechanism to pivot the base about a first axis, and a second pivot mechanism to pivot the connector about a second axis different than the first axis.

2. The print mechanism as defined in claim 1, wherein the first axis is parallel to the second axis.

3. The print mechanism as defined in claim 1, further comprising an opening in the base, the connector to pivot in the opening.

4. The print mechanism as defined in claim 1, wherein: the first axis is defined by the first pivot mechanism; and the second axis is defined by a shaft coupled to the second pivot mechanism.

5. The print mechanism as defined in claim 4, wherein the shaft is coupled to the base via a biasing element.

6. The print mechanism as defined in claim 5, wherein the biasing element comprises a first portion coupled to the shaft and a second portion coupled to the base.

7. The print mechanism as defined in claim 6, wherein the biasing element comprises a third portion positioned in an aperture of the base.

8. The print mechanism as defined in claim 5, wherein the biasing element is a first biasing element, and further comprising a second biasing element coupling the shaft to the base.

9. The print mechanism as defined in claim 5, wherein a portion of the biasing element is positioned between an extension portion of the second pivot mechanism and a retainer.

10. The print mechanism as defined in claim 1, further comprising an adapter including the connector, a power input, and a data input, wherein the connector includes a plurality of outputs.

11. The print mechanism as defined in claim 10, wherein the adapter further includes an alignment arm to guide engagement of the connector with the printhead assembly.

* * * * *